US007969270B2

(12) United States Patent
Berke et al.

(10) Patent No.: US 7,969,270 B2
(45) Date of Patent: Jun. 28, 2011

(54) COMMUNICATIONS TRANSFORMER

(75) Inventors: Walter M. Berke, Newark, CA (US); Gary Allman, San Jose, CA (US)

(73) Assignee: Echelon Corporation, San Jose, CA (US)

( * ) Notice: Subject to any disclaimer, the term of this patent is extended or adjusted under 35 U.S.C. 154(b) by 0 days.

(21) Appl. No.: 12/380,129

(22) Filed: Feb. 23, 2009

(65) Prior Publication Data

US 2010/0214052 A1 Aug. 26, 2010

(51) Int. Cl.
*H01F 27/28* (2006.01)
*H01F 27/24* (2006.01)

(52) U.S. Cl. ..... 336/182; 336/212

(58) Field of Classification Search ..... None
See application file for complete search history.

(56) References Cited

U.S. PATENT DOCUMENTS

| | | | | |
|---|---|---|---|---|
| 4,893,227 | A * | 1/1990 | Gallios et al. | 363/26 |
| 5,229,652 | A * | 7/1993 | Hough | 307/104 |
| 5,338,332 | A * | 8/1994 | Baran et al. | 75/247 |
| 5,563,922 | A * | 10/1996 | Beltz et al. | 376/258 |
| 7,034,647 | B2 * | 4/2006 | Yan et al. | 336/212 |

FOREIGN PATENT DOCUMENTS

JP 2000296254 A * 10/2000

* cited by examiner

*Primary Examiner* — Anh T Mai
(74) *Attorney, Agent, or Firm* — Blakely, Sokoloff, Taylor & Zafman LLP

(57) ABSTRACT

A communications transformer in which the primary and secondary windings are each divided into equal halves is disclosed. One primary and one secondary half winding is disposed about one section of a magnetic core, while the other halves are disposed about a second, parallel section. Voltages in the primary half windings and secondary half windings caused by stray magnetic fields are subtracted.

8 Claims, 3 Drawing Sheets

COMMUNICATIONS TRANSFORMER

FIELD OF THE INVENTION

The invention relates to the field of transformers particularly those used in communications.

PRIOR ART AND RELATED ART

Transformers are often used for isolation in communication systems. One of the most common ways to reduce noise pickup from stray magnetic fields in such transformers is to use a toroidal core with windings uniformly disposed around the full circumference of the toroid. Multiple windings are either wound on top of each other in layers or wound at the same time in a bifilar fashion. Uniformly spreading each winding about the circumference of the toroid results in cancellation of stray magnetic field pickup. This is true since windings on opposite sides of the toroid induced opposite polarity voltage signals. One such transformer is described in U.S. Pat. No. 6,507,260.

Because of the difficulty in building a toroidal transformer, they are relatively expensive.

SUMMARY OF THE INVENTION

An apparatus and method for a communications transformer having a closed loop magnetic core, a primary winding and a secondary winding. The primary winding is divided into first and second primary windings, each having an approximately equal number of turns. Similarly, the secondary winding is divided into first and second secondary windings, each having an approximately equal number of turns. The magnetic core has first and second spaced-apart parallel sections such as, in one embodiment, the sides of a rectilinear core. The first primary and first secondary windings are disposed about one of the sections of the core while the second primary and second secondary windings are disposed about the other section of the core. In this way magnetic fields or flux induced from external sources passes through the first primary and second primary windings in the same direction. The same is true for the first and secondary windings. However, the magnetic field resulting from current, for instance, in the primary windings, passes through the secondary windings in opposite directions. This allows subtraction of voltages resulting in the windings from stray fields while permitting addition of the voltages in the primary and secondary half windings resulting from signal applied to the windings.

DETAILED DESCRIPTION

A communications transformer is described. In the following description, specific embodiments are set forth such as an embodiment having a generally rectangular magnetic core. It will be apparent to one skilled in the art, that the present invention may be practiced without these specific details. In other instances, well-known devices and methods such as winding a bobbin, are not described to avoid unnecessarily obscuring the present invention.

Figure 1:
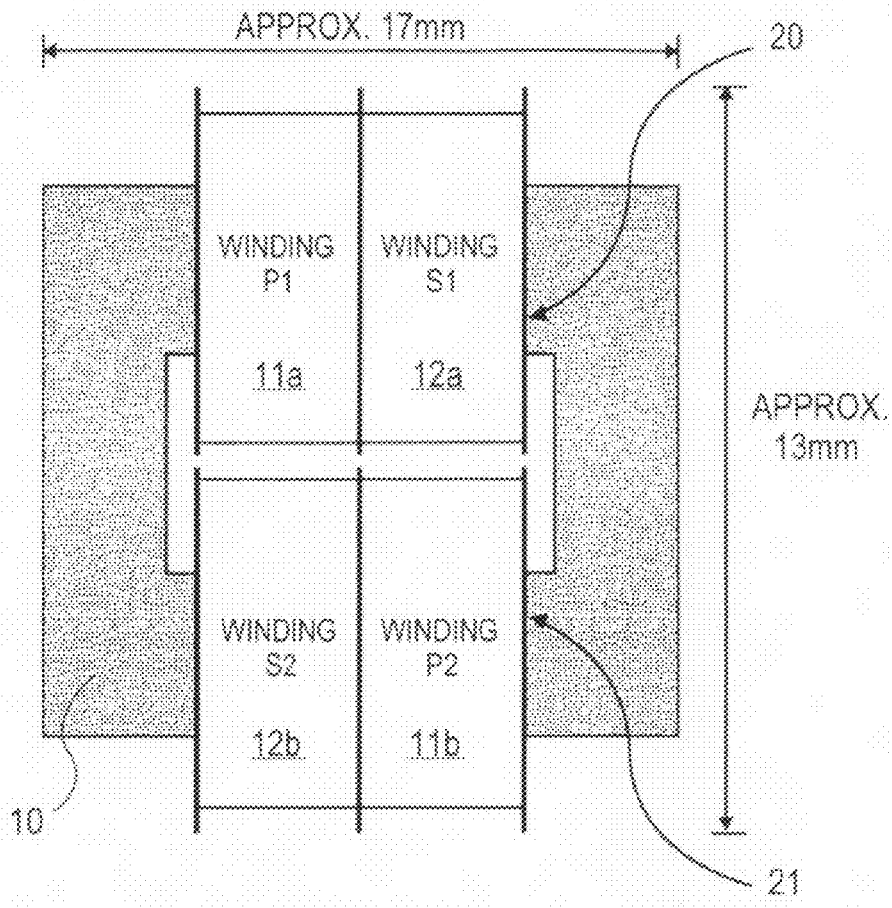
FIG. 1 is a plan view showing an embodiment of the described transformer.

Referring now to FIG. 1, a transformer is illustrated in one embodiment having a closed loop magnetic core 10 and four windings each disposed on a bobbin, specifically primary windings 11*a* and 11*b*, and secondary windings 12*a* and 12*b*. The approximate dimensions of the transformer for one embodiment are shown in FIG. 1.

The magnetic core 10 which may be formed from an ordinary magnetic core material, includes two parallel spaced-apart sections 20 and 21 which form the sides of the generally rectangular core 10. The core may have other shapes provided it has two generally parallel spaced-apart sections in its closed loop.

Both the primary and secondary windings are split into winding halves, each having approximately the same number of turns. Thus, the primary winding as shown in FIG. 1 includes a winding half 11*a* (P1) and a winding half 11*b* (P2). Similarly the secondary winding includes a winding half 12*a* (S1) and a winding half 12*b* (S2). For communications transformers, the number of turns in the primary and secondary windings are sometimes equal, and in this case, for practical purposes, there is no physical difference between the primary and secondary windings.

Figure 2:
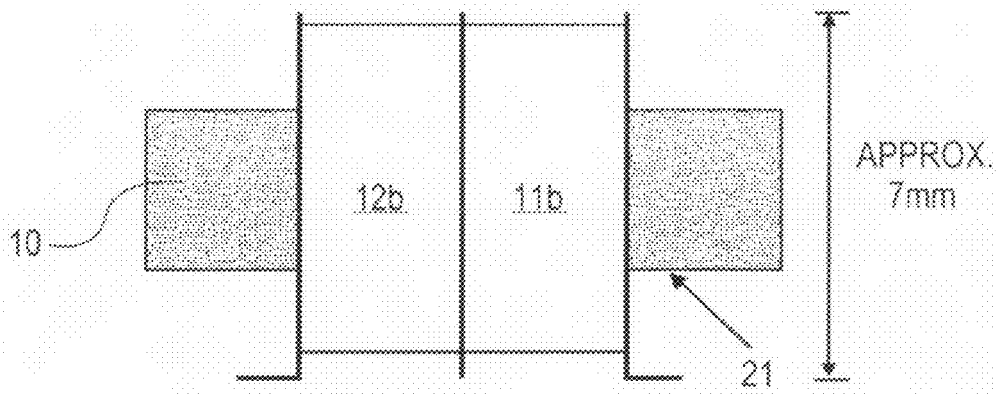
FIG. 2 is a side view of the transformer of in FIG. 1.

As can be seen in FIG. 1, one half of the primary winding and one half of the secondary winding are disposed about one section 20 of the core 10. The other halves comprising the other halves of the primary winding and secondary winding are disposed about the other, parallel section 21 of the core 10. The side view of FIG. 2 shows the windings 11*b* and 12*b* disposed about the section 21 of the core 10. Similarly if viewed from the other side the windings 11*a* and 12*a* are disposed about the section 20 of the core 10.

Figure 3:
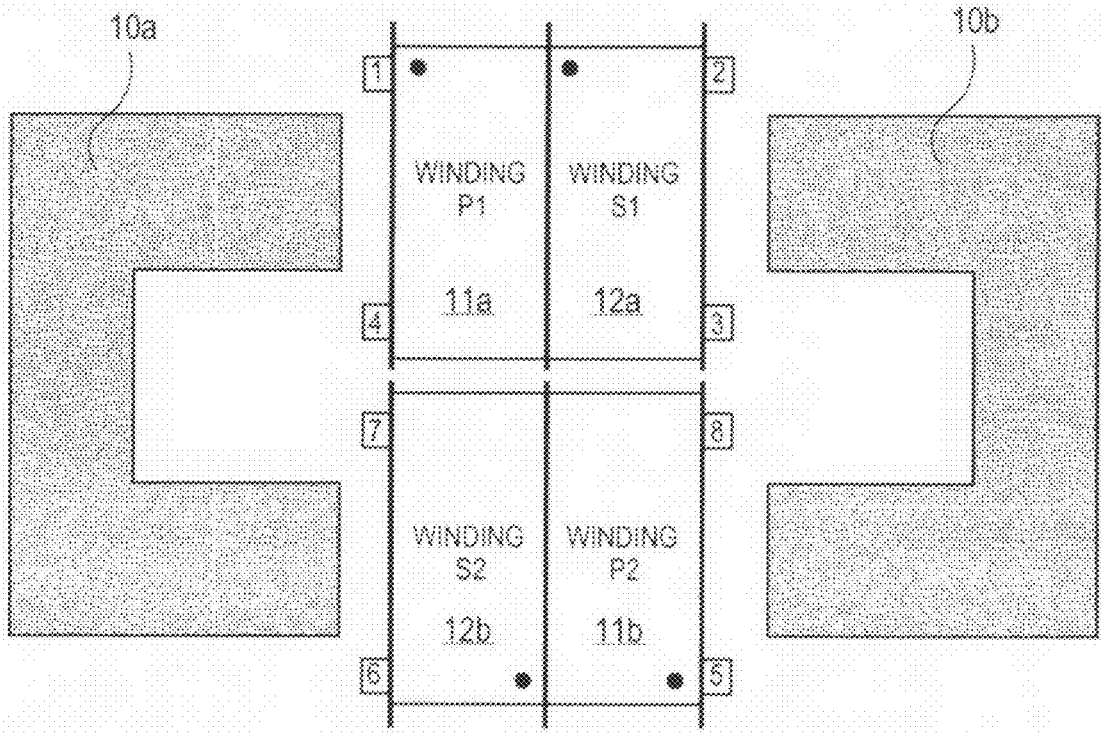
FIG. 3 illustrates a method of fabricating the transformer of FIGS. 1 and 2.

Referring now to FIG. 3, in one embodiment the core 10 is fabricated from two half cores 10*a* and 10*b*. These cores are slid into the bobbins on which the windings are wound and then clamped together. In this manner, the fabrication of the transformer is substantially easier than winding a toroidal core. Dots are shown in the corners of each of the windings of FIG. 3 to indicate the direction of the winding as is customarily done. Also in FIG. 3 the ends of the winding halves are shown as tabs 1-8 for the four windings of FIG. 3.

In an alternate embodiment, the winding-halves P1 and S1 may be wound in a bifilar winding on a single bobbin. Similarly, the winding-halves P2 and S2 may be a bifilar winding on a single bobbin.

In another embodiment, the number of turns in the primary winding-halves (P1 and P2) may be different than the number of turns in the secondary winding-halves (S1 and S2). This allows the matching, for instance, of different voltages used in a network versus that used in a transceiver.

Figure 4:
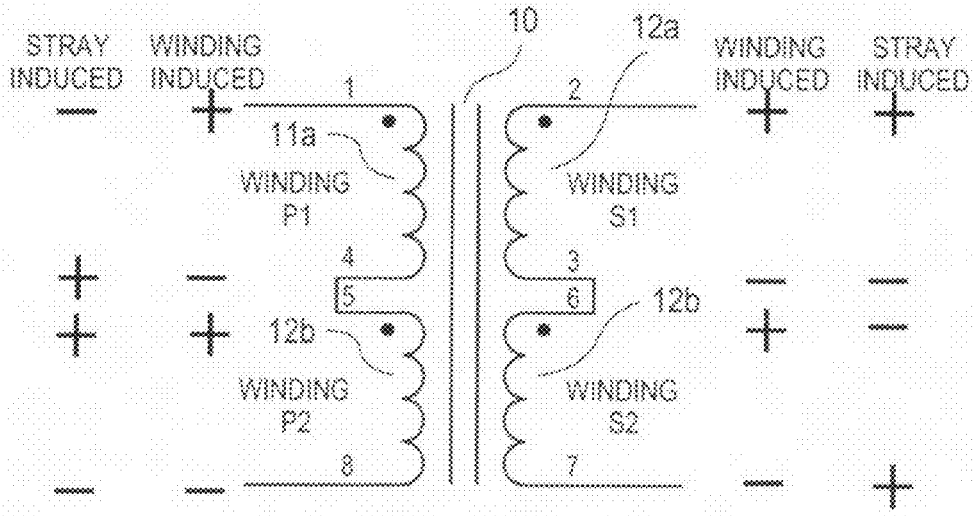
FIG. 4 is an electrical schematic showing electrical connections between the two primary windings and two secondary windings of the transformers of FIGS. 1-3.

As will be described in more detail in conjunction with FIGS. 5 and 6, the windings are connected such that a voltage induced in the two primary winding halves caused by a stray magnetic field is subtracted, while voltages induced from the magnetic field caused by a signal in the secondary winding halves is added. The same is true for the secondary winding. The specific connections are shown in FIG. 4 for the tabs 1-8 of the windings 11*a*, 11*b*, 12*a* and 12*b*.

Figure 5:
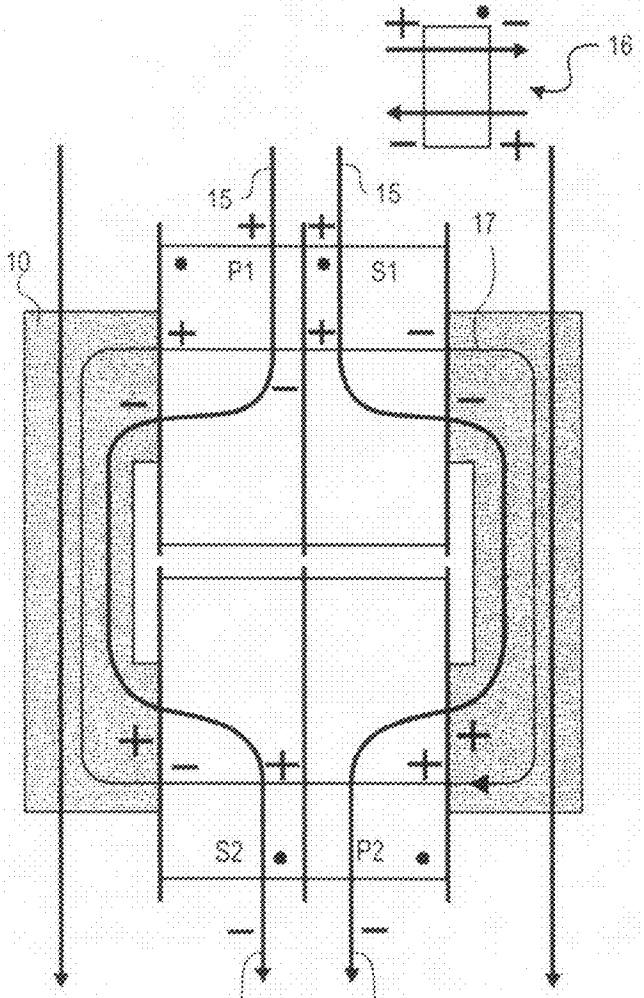
FIG. 5 illustrates the stray magnetic field in the core of the transformer as well as a field caused by a signal in the primary or secondary winding.

In FIG. 5, a stray magnetic field 15 is shown entering the magnetic core 10 at one side of the core (top of the drawing) and leaving the opposite side of the core (bottom of the drawing of FIG. 5). This field can result from leakage from another transformer, a magnetic relay or other source of a magnetic field external to the transformer. The field 15 passes through the primary and secondary winding halves (P1 and S1) at the top of the figure and through the other halves of the primary and secondary windings (S2 and P2) at the bottom of the figure. Note that the field is passing in one direction through P1 and in the opposite direction through P2 (from the standpoint of the winding direction). Similarly, the field 15 passes in one direction through S1 and the opposite direction through S2. In contrast, the field 17 which is contained entirely within the core and results from current in one of the windings, passes through P1 and P2 in the same direction and similarly passes through S1 and S2 in the same direction. This enables a subtraction of the voltage caused by the stray magnetic field, while the voltage induced in primary windings, for instance, caused by a signal in the secondary windings can be added.

A winding 16 is shown in FIG. 5 to provide a convention to understand the operation of the transformer of FIG. 5. The winding 16 includes a dot to indicate the direction of winding. For the selected convention assume that a field or flux directed from left-to-right as shown by the upper arrow through winding 16 provides a negative potential at the dot side of the winding. In contrast, the field directed from right-to-left provides the opposite polarity on the winding 16 as shown by the lower arrow.

Using this convention and applying it to FIG. 5, we see for instance that for P1 the field 15 provides a negative potential on the dot side of the winding, and for S1 a positive potential on the dot side of S1. Referring to FIG. 4, the potential induced in P1 is listed under the column "stray induced." On the dot side of the winding it is a negative potential whereas the other side of the winding is a positive potential. Examining winding P2 and the flux 15 as it passes through that winding, the dot side of P2 is a positive potential and its other end a negative potential. As can be seen the potentials from P1 and P2 from the stray induced field subtract. Similarly, for the secondary windings S1 and S2 under the column stray induced of FIG. 4, it can be seen that the potentials are also subtracted.

In contrast, looking at the field 17 of FIG. 5 as it passes through P2, the dot side of the winding is positive while the other end of the winding is negative. This is shown in FIG. 4 under the "winding induced" column for the winding P2. When examining all the potentials induced in the windings resulting from the field 17, it can be seen that this field provides potentials in the primary windings P1 and P2 which are added, and likewise, in the secondary windings S1 and S2. Note that the field 17 is the result of a signal in one of the primary or secondary windings with the potentials occurring in the other of the primary or secondary windings.

Figure 6:
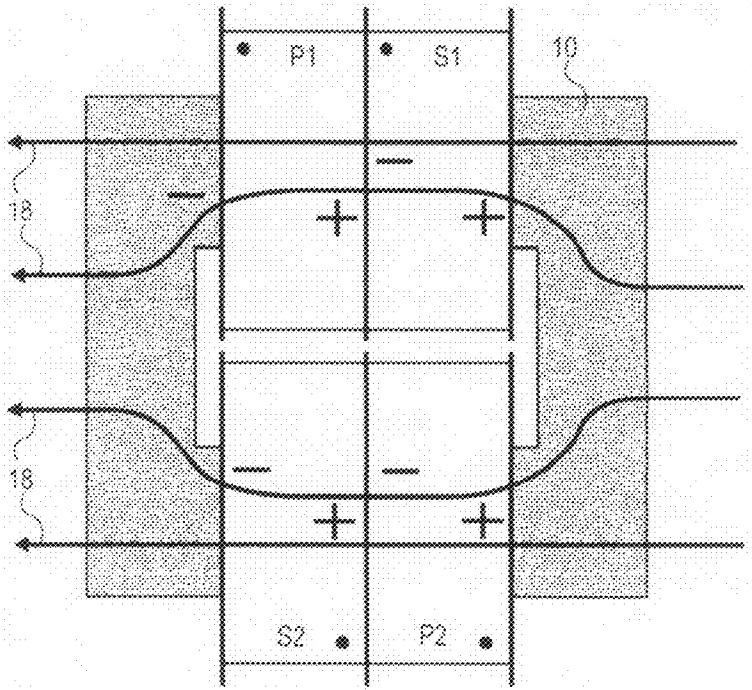
FIG. 6 also illustrates a stray magnetic field in the core, however with the stray field being from a different direction.

FIG. 6 illustrates what occurs when the field is from the side as shown by field 18. Once again it can be seen that the voltages in the primary winding halves for the field 18 subtract with the connections of FIG. 4 and similarly the voltages in the secondary winding halves subtract when connected as shown in FIG. 4. Thus even with the field at a right angle to the field of FIG. 5, the effect of the stray magnetic field is cancelled.

Also when bifilar windings are used, the voltages in the windings halves from the stray fields cancel each other, whereas the voltages from a winding induced field are added in P1 and P2, or in S1 and S2.

The same cancelling of the voltage from the stray field and adding of the voltage from a winding induced field occurs when the number of turns in the primary winding are unequal to the number of turns in the secondary winding.

Therefore, a communications transformer has been disclosed which is easy to fabricate and yet provides substantial immunity to stray magnetic fields.

What is claimed is:

1. A communications transformer comprising:

a closed loop magnetic core which includes first and second, spaced-apart parallel sections;

a primary winding divided into a first and second primary winding, each having an approximately equal number of turns, the first primary winding being disposed about the first section of the magnetic core and the second primary winding being disposed about the second section of the magnetic core, the first and second primary windings having a first connection such that the same current flows through both the first and second primary windings; and a secondary winding divided into a first and second secondary winding, each having an approximately equal number of turns, the first secondary winding being disposed about the first section of the magnetic core and the second secondary winding being disposed about the second section of the magnetic core, the first and second secondary windings having a second connection such that the same current flows through both the first and second secondary windings.

2. The transformer defined by claim 1, wherein the first connection connects the first and second primary windings such that voltages in the first and second primary windings caused by a stray magnetic field are subtracted and such that voltages in the first and second primary windings caused by a magnetic field resulting from a current in the secondary winding are added.

3. The transformer defined by claim 2, wherein the second connection connects the first and second secondary windings such that voltages in the first and second secondary windings caused by a stray magnetic field are subtracted and such that voltage in the first and second secondary windings caused by a current in the primary winding are added.

4. The transformer defined by claim 1, wherein the first and second primary windings have an approximately equal number of turns as the first and second secondary windings.

5. The transformer defined by claim 4, wherein the closed loop magnetic core is generally rectangular.

6. A method for fabricating a communications transformer having a closed loop magnetic core, a primary winding, and a secondary winding where the core is subjected to an induced magnetic field from current in the primary and secondary windings, and a stray magnetic field comprising:

separating the primary windings into a first and second primary winding, each having an approximately equal number of turns;

separating the secondary winding into a first and second secondary winding, each having an approximately equal number of turns; and connecting the first and second primary winding such that the same current flows through both first and second primary windings;

connecting the first and second secondary windings such that the same current flows through both first and second secondary windings;

placing the windings about the closed loop core such that the direction of the stray magnetic field through the first and second primary windings is the same, and the stray field in the first secondary and second secondary winding is the same, and the direction of the induced magnetic field through the first primary and second primary windings are in an opposite direction, and the induced magnetic field in the first secondary and second secondary windings is in an opposite direction.

7. The method defined by claim 6, including connecting together the first and second primary windings such that voltages in the first and second primary windings caused by the stray magnetic field are subtracted and such that voltages in the first and second primary windings caused by the induced magnetic field are added.

8. A method for fabricating a communications transformer having a closed loop magnetic core, a primary winding, and a secondary winding where the core is subjected to an induced magnetic field from current in the primary and secondary windings, and an external magnetic field comprising:

separating the primary windings into a first and second primary winding, each having an approximately equal number of turns;

separating the secondary winding into a first and second secondary winding, each having an approximately equal number of; and connecting together the first and second primary windings such that voltages in the first and second primary windings caused by the external magnetic field is subtracted and such that voltages in the primary windings caused by the induced magnetic field are added and such that the same current flows through both first and second primary windings; and connecting together the first and second secondary windings such that voltages in the first and second secondary windings caused by the external magnetic field are subtracted and such that voltages in the first and second secondary windings caused by the induced magnetic field are added and such that the same current flows through both first and second secondary windings.

* * * * *